US007703652B2

(12) United States Patent
Shen

(10) Patent No.: US 7,703,652 B2
(45) Date of Patent: Apr. 27, 2010

(54) PAPER TOOL CONSTRUCTION

(75) Inventor: Zhe Shen, Palatine, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 55 days.

(21) Appl. No.: 11/961,111

(22) Filed: Dec. 20, 2007

(65) Prior Publication Data

US 2009/0159636 A1 Jun. 25, 2009

(51) Int. Cl.
*B25C 1/04* (2006.01)

(52) U.S. Cl. ..... 227/134; 227/120

(58) Field of Classification Search ..... 227/132, 227/134, 120

See application file for complete search history.

(56) References Cited

U.S. PATENT DOCUMENTS

| | | | | |
|---|---|---|---|---|
| 2,107,522 | A | 2/1938 | Cavanagh | |
| 2,147,380 | A | 2/1939 | Peterson | |
| 2,545,397 | A | 3/1951 | Wampler | |
| 2,735,094 | A | 2/1956 | Plotkin | |
| 3,665,580 | A | 5/1972 | Mashita | |
| 4,014,493 | A * | 3/1977 | Wolfe | 227/156 |
| 4,182,474 | A | 1/1980 | Sato | |
| 4,288,019 | A * | 9/1981 | Dahle | 227/144 |
| 4,648,531 | A | 3/1987 | Won | |
| 4,878,608 | A * | 11/1989 | Mitsuhashi | 227/120 |
| 4,984,729 | A * | 1/1991 | Balma | 227/128 |
| 5,356,063 | A * | 10/1994 | Perez | 227/132 |
| 5,421,502 | A * | 6/1995 | Huang | 227/134 |
| 5,699,949 | A | 12/1997 | Marks | |
| 5,704,533 | A | 1/1998 | Chang | |
| 5,758,813 | A | 6/1998 | Kikuchi et al. | |
| 5,816,470 | A | 10/1998 | Plato et al. | |
| 5,890,642 | A | 4/1999 | Sato | |
| 6,142,355 | A * | 11/2000 | Wu | 227/134 |
| 6,550,661 | B2 | 4/2003 | Aoki | |
| 6,776,321 | B2 | 8/2004 | Jairam et al. | |
| 6,942,136 | B2 | 9/2005 | Tsai | |
| 6,966,479 | B2 | 11/2005 | Tanaka et al. | |

(Continued)

FOREIGN PATENT DOCUMENTS

DE 3215517 11/1982

(Continued)

OTHER PUBLICATIONS

Annex to Form PCT/ISA/206 Communication Relating To The Results Of The Partial International Search Report for PCT/US2007/088330 dated Sep. 10, 2008.

(Continued)

*Primary Examiner*—Scott A. Smith
(74) *Attorney, Agent, or Firm*—Michael Best & Friedrich LLP

(57) ABSTRACT

A paper tool includes a base having a front end and a rear end and a drive arm pivotally coupled to the base about a first pivot axis. The drive arm includes a front portion proximate the front end of the base and a rear portion proximate the rear end of the base. The stapler also includes a handle pivotally coupled to the base and a drive member supported by the handle rearwardly of the first pivot axis such that, when the handle pivots relative to the base, the drive member engages the rear portion of the drive arm to pivot the drive arm about the first pivot axis.

28 Claims, 11 Drawing Sheets

U.S. PATENT DOCUMENTS

| | | | | |
|---|---|---|---|---|
| 7,097,086 | B2 | 8/2006 | Joyce et al. | |
| 7,118,019 | B2 | 10/2006 | Marks | |
| 7,124,922 | B2 * | 10/2006 | Marks | 227/8 |
| 7,124,924 | B2 | 10/2006 | Marks | |
| 7,140,526 | B2 | 11/2006 | Matsukawa | |
| 7,178,709 | B2 | 2/2007 | Marks | |
| 7,216,791 | B1 | 5/2007 | Marks | |
| 2005/0199675 | A1 | 9/2005 | Takada | |
| 2006/0108392 | A1 | 5/2006 | Chang | |
| 2006/0213949 | A1 | 9/2006 | Marks | |
| 2006/0231583 | A1 | 10/2006 | Kumayama | |
| 2007/0057012 | A1 | 3/2007 | Kandasamy et al. | |
| 2007/0125823 | A1 | 6/2007 | Marks | |
| 2007/0145094 | A1 | 6/2007 | Chou | |
| 2007/0158384 | A1 | 7/2007 | Zins et al. | |
| 2007/0199971 | A1 | 8/2007 | Chen | |
| 2007/0221699 | A1 | 9/2007 | Hsu | |

FOREIGN PATENT DOCUMENTS

| | | |
|---|---|---|
| GB | 1502776 | 3/1978 |
| WO | WO02070209 | 9/2002 |

OTHER PUBLICATIONS

International Search Report and Written Opinion for PCT/US2007/088330 dated Nov. 10, 2008.

* cited by examiner

PAPER TOOL CONSTRUCTION

BACKGROUND

The present invention relates to paper tools and, more particularly, to constructions of paper tools for reduced force input requirements.

Staplers are commonly used to impart a staple through one or more sheets to bind the sheets together. Typically, a stapler includes a base, a magazine pivotally mounted to the base, and a drive arm including a driver that can force a staple from the magazine through the sheets. The drive arm is pivotally mounted to either the magazine or the base and is usually directly engaged by a user to drive the staple. Other paper tools, such as punches and trimmers/cutters, can include similar components constructed in a similar manner to staplers.

SUMMARY

In one embodiment, the invention provides a paper tool including a base having a front end and a rear end and a drive arm pivotally coupled to the base about a first pivot axis. The drive arm includes a front portion proximate the front end of the base and a rear portion proximate the rear end of the base. The paper tool also includes a handle pivotally coupled to the base and a drive member supported by the handle rearwardly of the first pivot axis such that, when the handle pivots relative to the base, the drive member engages the rear portion of the drive arm to pivot the drive arm about a first pivot axis.

In some embodiments, the paper tool can be a stapler including a magazine pivotally coupled to the base and a driver coupled to the drive arm. The driver is operable to drive a staple from the magazine.

In other embodiments, the paper tool can be a punch including a punch pin coupled to the drive arm. The punch pin is operable to punch a sheet.

In further embodiments, the paper tool can be a trimmer including a cutting blade coupled to the drive arm. The cutting blade is operable to cut a sheet.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Although references are made below to direction, such as "top," "bottom," "front," "rear," "upper," "lower," or the like, the references are made relative to the drawings (as normally viewed) for convenience. These directions are not intended to be taken literally or to limit the present invention in any form.

Figure 1:
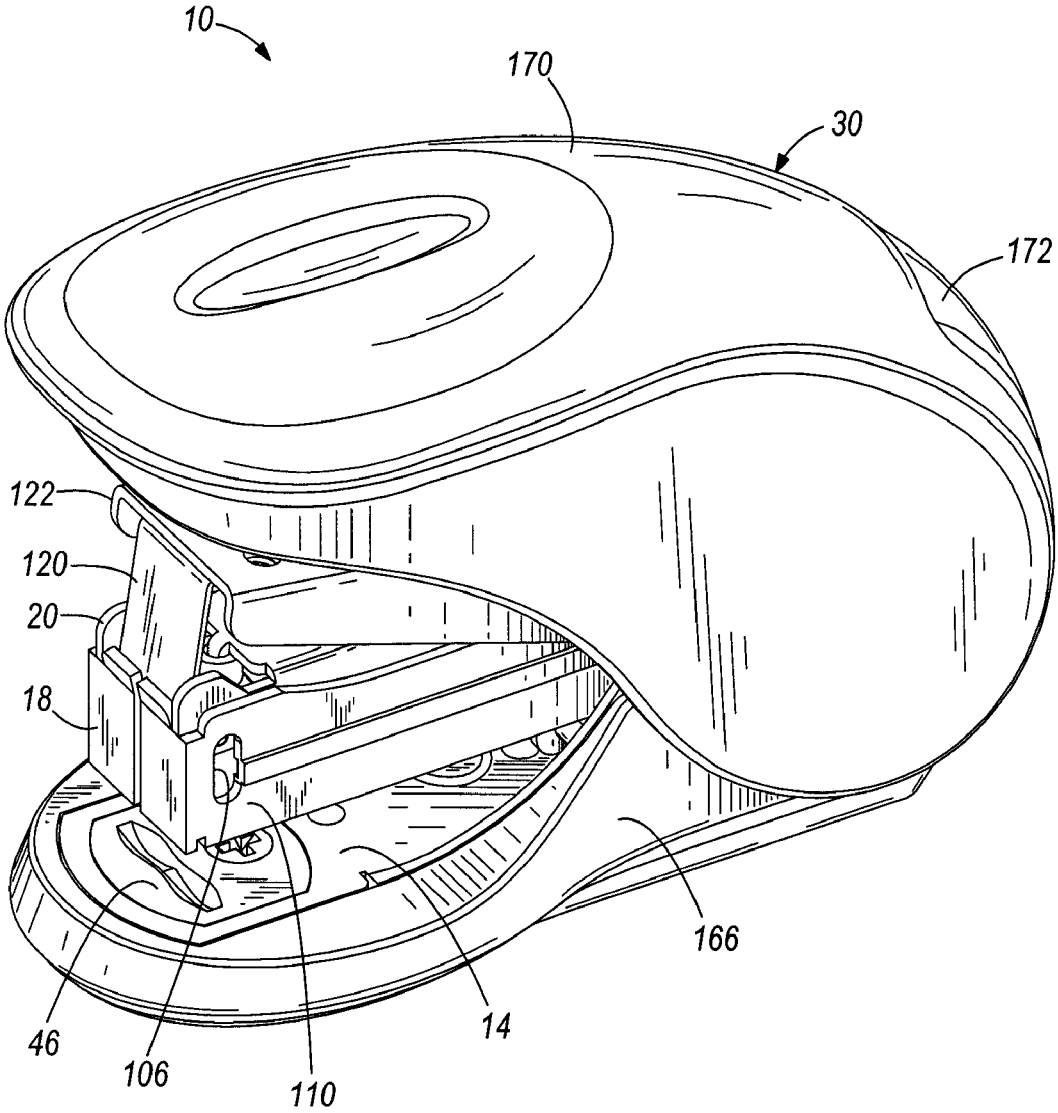
FIG. 1 is a perspective view of a stapler embodying the present invention.

FIG. 1 illustrates a paper tool 10 embodying the present invention. In the illustrated embodiment, the paper tool 10 is a stapler operable to bind (i.e., staple) two or more sheets of paper or other material. In other embodiments, the paper tool may be, for example, a hole punch (FIG. 6) operable to punch a hole in one or more sheets of paper, a paper cutter (FIG. 7) operable to cut one or more sheets of paper, or the like. In some embodiments, the stapler 10 may be a heavy duty stapler operable to staple up to about sixty sheets of paper.

Figure 2:
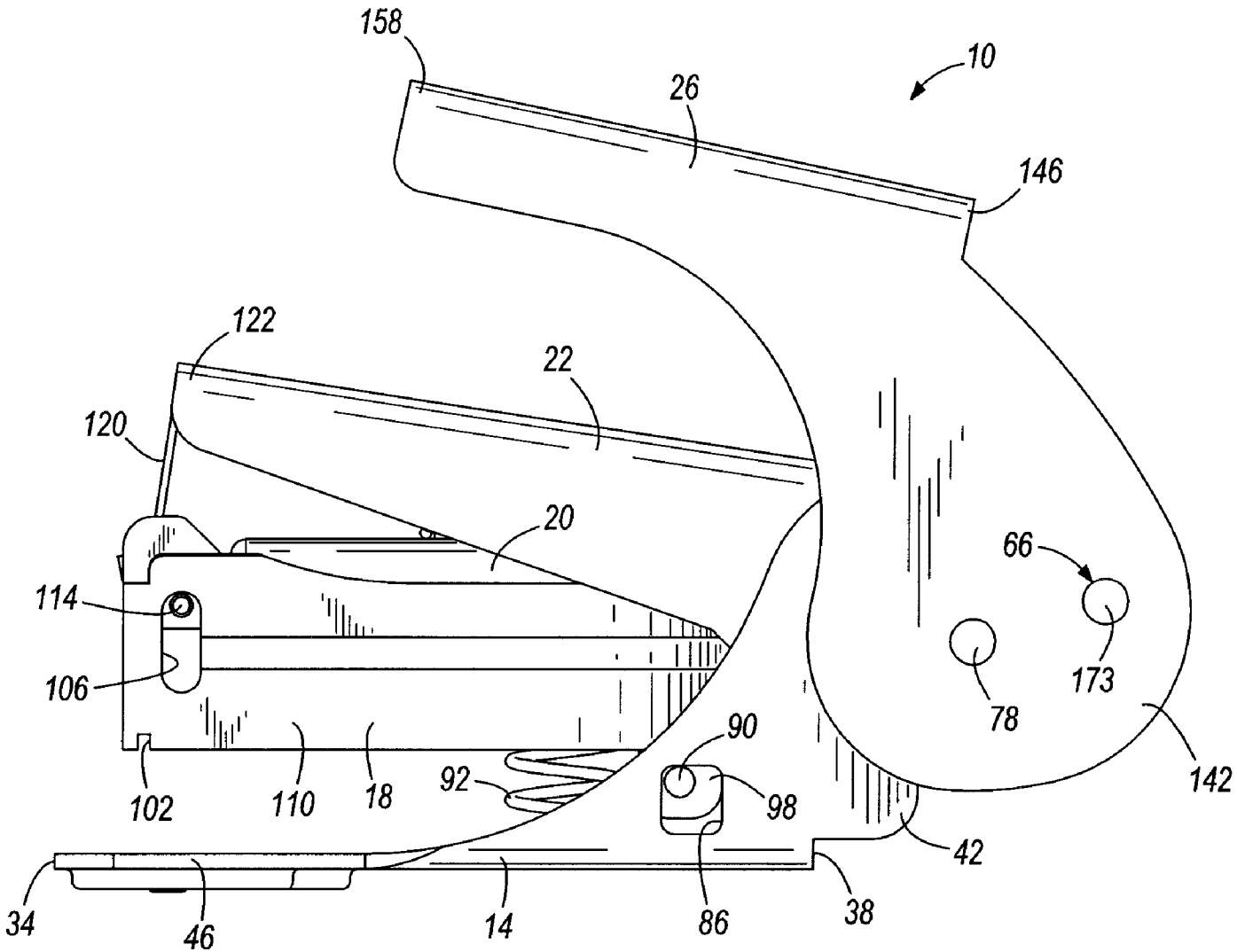
FIG. 2 is a side view of the stapler of FIG. 1 shown without a housing assembly and in a rest or raised static position.
Figure 3:
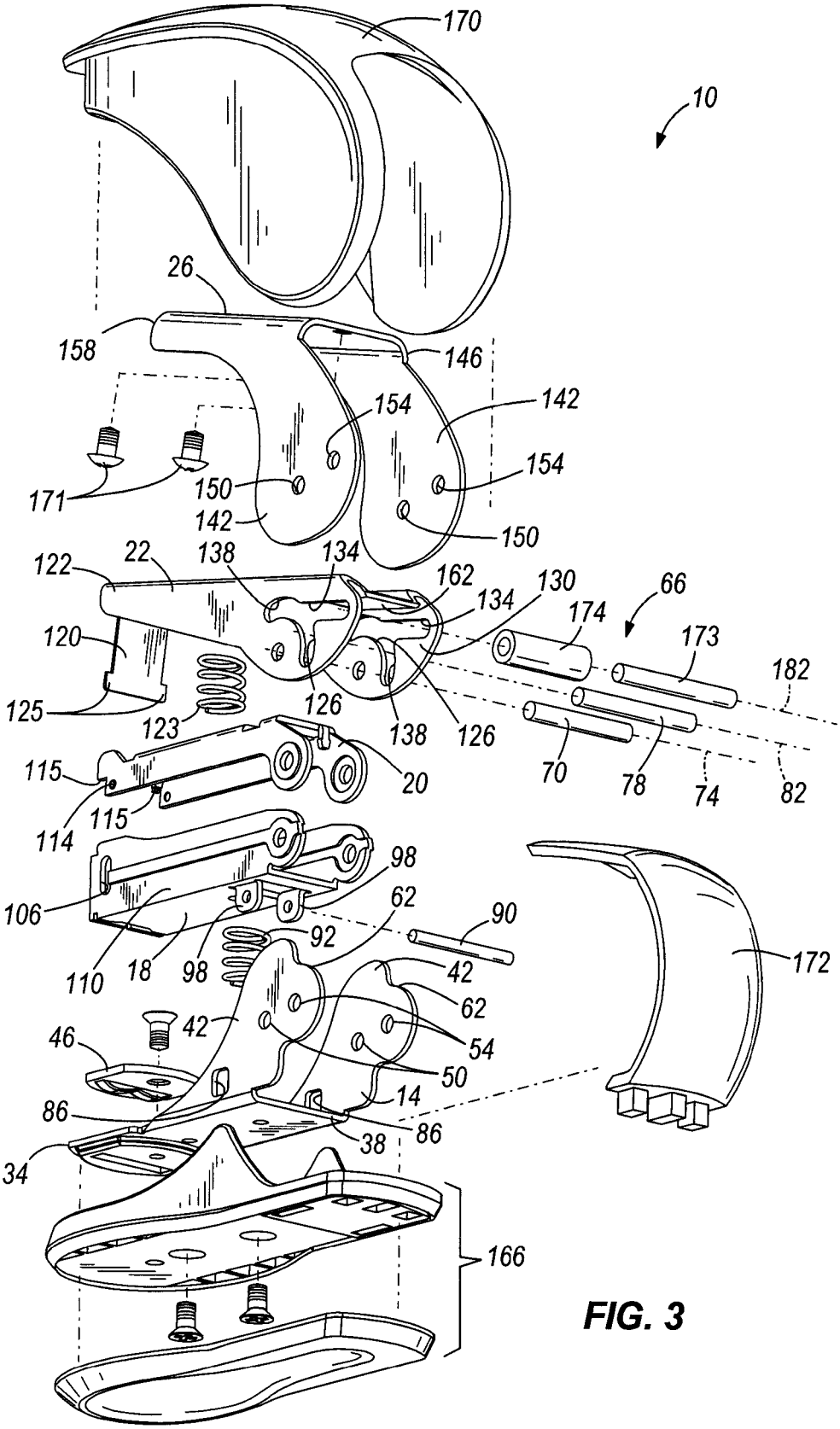
FIG. 3 is an exploded rear perspective view of the stapler of FIG. 1.

As shown in FIGS. 1-4C, the illustrated stapler 10 includes a base 14, a magazine 18, a case 20, a drive arm 22, a handle 26, and a housing assembly 30. The illustrated base 14 includes a front end 34, a rear end 38, two flanges 42 extending upwardly from the rear end 38, and an anvil 46 configured to engage and bend a staple. Each flange 42 includes two apertures 50, 54 (FIG. 3) and is positioned adjacent to one side of the magazine 18 and the drive arm 22. An upper surface 58 of each flange 42, or hip, includes a notch 62 to provide clearance for a drive member 66, as further discussed below. The first apertures 50 receive a first pin 70 defining a first pivot axis 74 to pivotally couple the magazine 18 and the drive arm 22 to the base 14. The second apertures 54 receive a second pin 78 defining a second pivot axis 82 to pivotally couple the handle 26 to the base 14. As shown in FIGS. 3 and 4A, the second pin 78 is disposed rearwardly of the first pin 70 (i.e., closer to the rear end 38 of the base 14), but at substantially the same height, or elevation, as the first pin 70. In some embodiments, the second pin 78 may be positioned at a different height than the first pin 70.

In the illustrated embodiment, each flange 42 also includes a generally square window 86 (FIG. 2) configured to receive a magazine pin 90. The illustrated magazine pin 90 moves within the windows 86 and limits the pivoting range of the magazine 18 relative to (e.g., away from) the base 14.

Figure 4A:
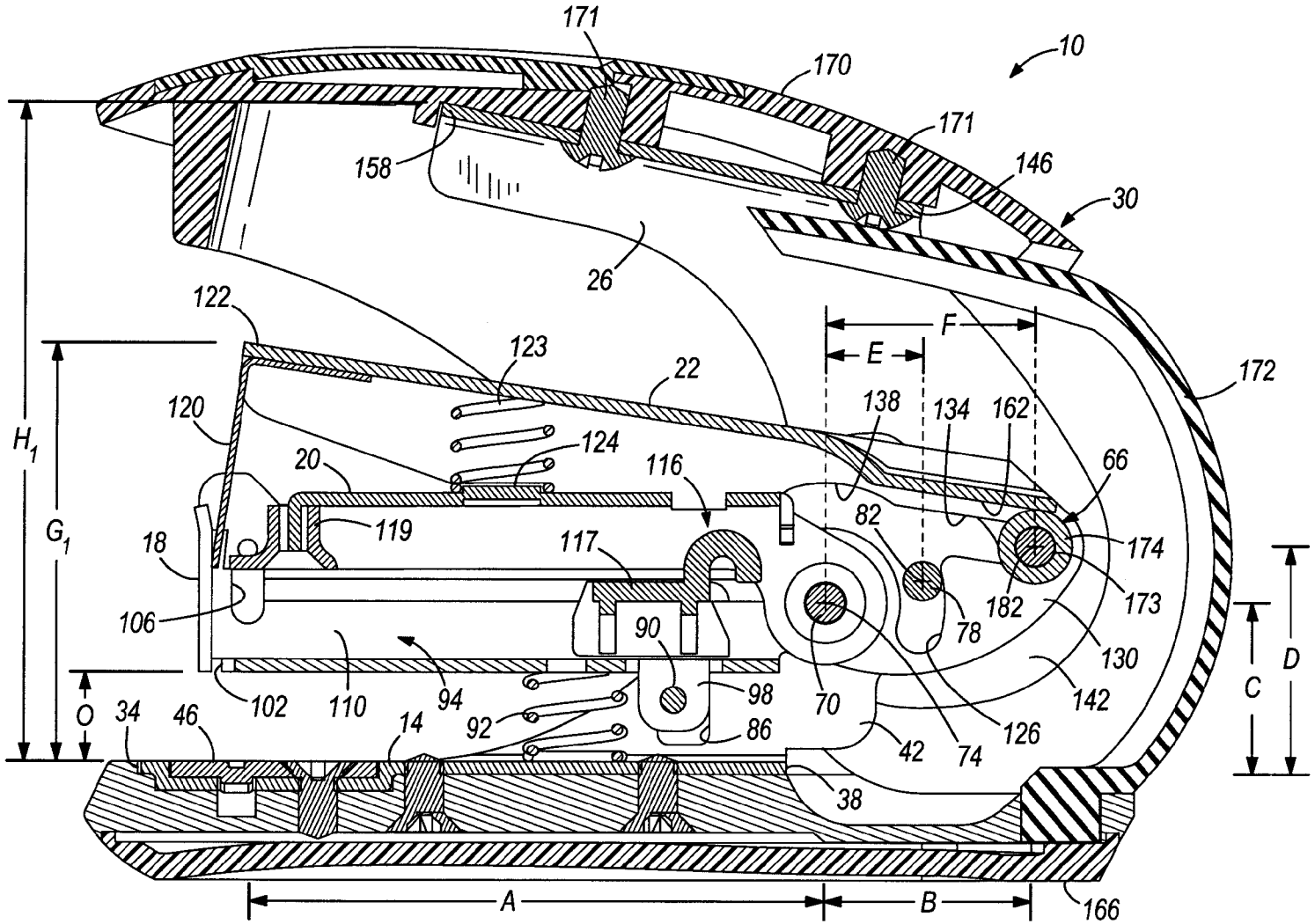
FIG. 4A is a cross-sectional view of the stapler of FIG. 1 shown in the rest position.
Figure 4B:
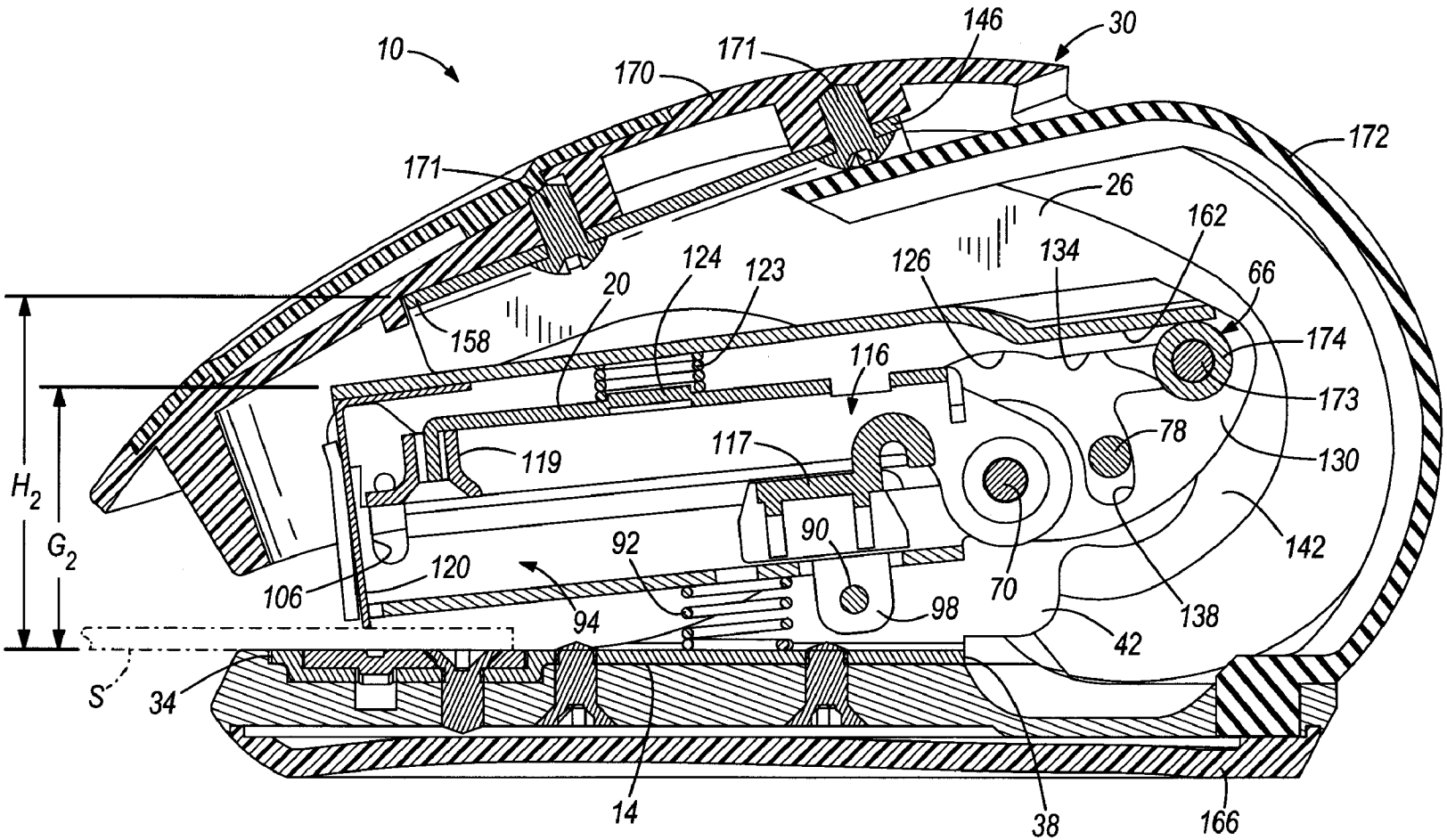
FIG. 4B is a cross-sectional view of the stapler of FIG. 1 shown in a stapling or lowered operating position.
Figure 4C:
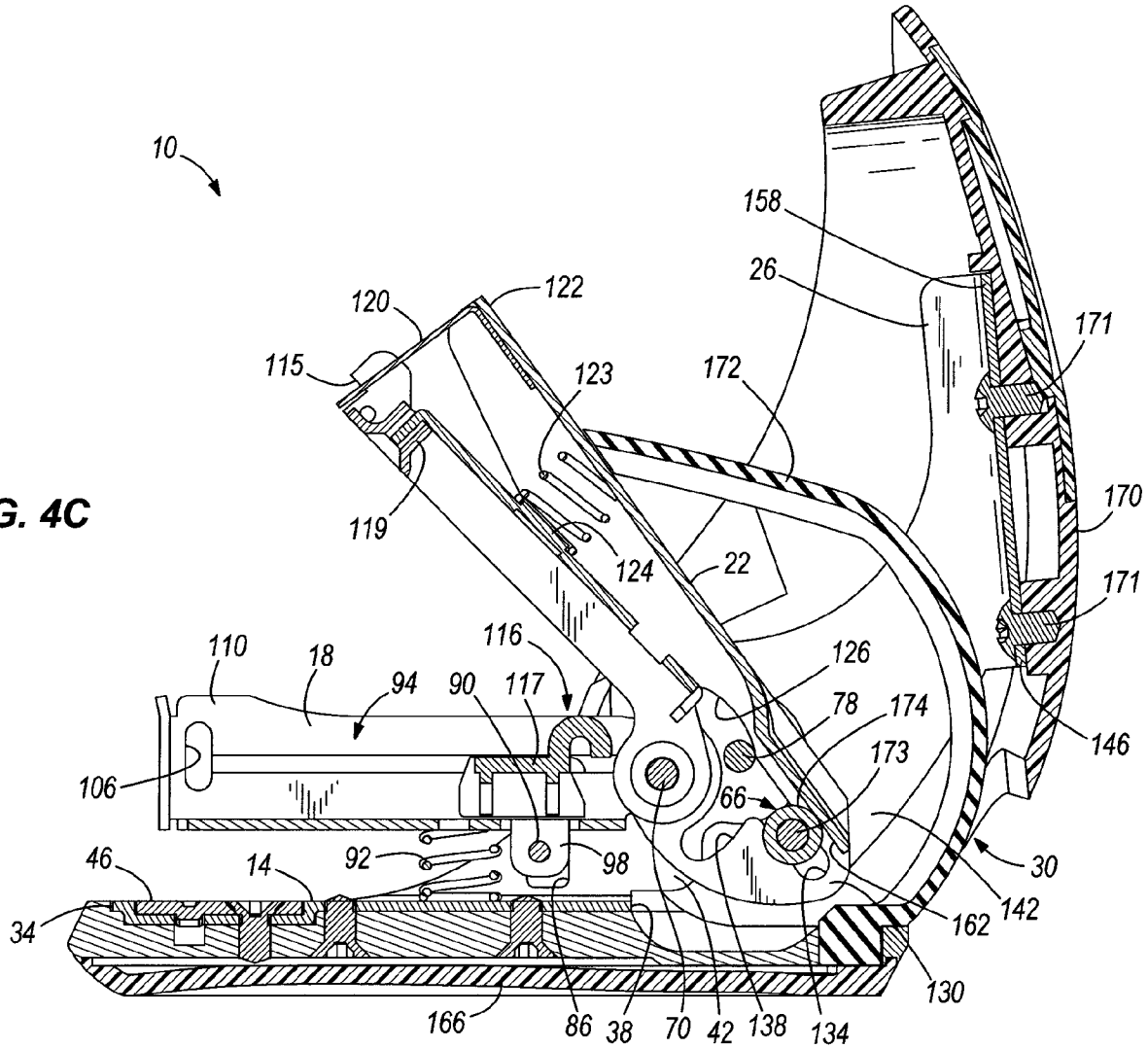
FIG. 4C is a cross-sectional view of the stapler of FIG. 1 shown in an open position.

The illustrated magazine 18 is pivotally coupled to the base 14 about the first pivot axis 74 by the first pin 70. As shown in FIGS. 4A-4C, the magazine 18 is biased away from the base 14 by a biasing member 92. In the illustrated embodiment, the biasing member 92 is a coil spring, although other suitable biasing members may also be employed.

The illustrated magazine 18 defines a chamber 94 configured to retain staples and includes two downwardly extending tabs 98. The illustrated tabs 98 correspond to the windows 86 in the flanges 42 of the base 14 and support the magazine pin 90. A slot 102 at the front of the magazine 18 is configured to pass a staple out of the chamber 94.

In the illustrated embodiment, the magazine 18 also includes an elongated opening 106 on each sidewall 110 of the magazine 18. The openings 106 receive corresponding protrusions 114, or detents, of the case 20 to limit the pivotal movement of the case 20 and the drive arm 22 away from the magazine 18. However, the illustrated protrusions 114 extend only partially into the openings 106 such that the protrusions 114 may be manually released out of the openings 106 to open the case 20 and the drive arm 22 relative to the magazine 18, facilitating refilling of the chamber 94 with staples.

The illustrated case 20 is also pivotally coupled to the base 14 by the first pin 70. As shown in FIGS. 2 and 4A, the case 20 is partially received within the magazine 18 to help define the chamber 94. The case 20 includes two shoulders 115 (FIG. 3) that engage an upper surface of the magazine 18 to pivot the magazine 18 about the first pivot axis 74 toward the base 14 when the case 20 pivots toward the base 14.

As shown in FIGS. 4A-4C, a pusher assembly 116 is supported between the magazine 18 and the case 20 in the chamber 94. The illustrated pusher assembly 116 includes a slide member 117 and a biasing member (e.g., a coil spring) (not shown). The biasing member is not shown in the figures to help clarify other portions of the stapler 10. The biasing member is coupled between a rear portion of the case 20, wraps around a boss 119 extending from the case 20 into the chamber 94, and couples to the slide member 117. When the case 20 is closed relative to the magazine 18 (as shown in FIGS. 4A and 4B), the biasing member pulls the slide member 117 to bias the staples toward the slot 102. When the case 20 is opened relative to the magazine 18 (as shown in FIG. 4C), the biasing member pulls the slide member 117 away from the slot 102.

In the illustrated embodiment, the drive arm 22 is pivotally coupled to the base 14 and the magazine 18 about the first pivot axis 74 by the first pin 70 and includes a driver 120 (FIGS. 4A-4C) coupled to a front portion 122 of the drive arm 22. In other embodiments, the drive arm 22 may be coupled to the base 14 about a different pivot axis. A biasing member 123 (e.g., a coil spring) is coupled to a seat 124 formed on the case 20 to bias the drive arm 22, and thereby the handle 26, away from the case 20 and the magazine 18. When the drive arm 22 is pivoted downwardly, as shown in FIG. 4B, the illustrated driver 120 is operable to force (i.e., drive or push) a staple from the chamber 94 of the magazine through the slot 102 toward the anvil 46. When the drive arm 22 is pivoted upwardly, as shown in FIG. 4C, flanges 125 (FIG. 3) on the drive member 120 engage the shoulders 115 of the case 20 to pivot the case 20 to the open position relative to the magazine 18.

The illustrated drive arm 22 also includes a generally T-shaped slot 126 formed in each rear portion 130, or wing, of the drive arm 22. The slots 126 provide clearance to allow the drive member 66 and the second pin 78 to move relative to the drive arm 22 when the handle 26 is pivoted. As shown in FIG. 3, a generally linear portion 134 of each T-shaped slot 126 allows lateral movement of the drive member 66 relative to the drive arm 22, while an arcuate portion 138 of each slot 126 allows the drive arm 22 to open relative to the magazine 18 (as shown in FIG. 4C). In the illustrated embodiment, the linear portion 134 and the arcuate portion 138 are in communication to form a single slot. In other embodiments, the linear portion 134 and the arcuate portion 138 may be formed as two separate slots.

The illustrated handle 26 is pivotally coupled to the base 14 about the second pivot axis 82 by the second pin 78. As shown in FIG. 3, the handle 26 includes two flanges 142 extending downwardly from a rear portion 146 of the handle 26. The illustrated flanges 142 generally correspond to the upwardly extending flanges 42 of the base 14 and are positioned to the outside of the upwardly extending flanges 42. In the illustrated embodiment, each flange 142 of the handle 26 includes two apertures 150, 154. The first apertures 150 receive the second pin 78 to pivotally couple the handle 26 to the base 14, while the second apertures 154 receive and support the drive member 66. As shown in FIGS. 3 and 4A, the drive member 66 is disposed rearwardly of and substantially higher than (i.e., further from the base 14) the first pin 70 and the second pin 78 when in the rest, or static, position. As a front portion 158 of the handle 26 pivots downwardly about the second pivot axis 82, the handle 26 lifts the drive member 66 away from the base 14 such that the drive member 66 engages and exerts an upward force on a lower surface 162 of the drive arm 22, pivoting the drive arm 22 about the first pivot axis 74. In other embodiments, the drive member 66 may exert an upward force on a upper surface of each slot 126.

As shown in FIGS. 1 and 4A-4C, the illustrated housing assembly 30 includes a lower housing portion 166 substantially surrounding the base 14 and an upper housing portion 170 substantially surrounding the handle 26. The illustrated upper housing 170 is fixed to the handle 26 with fasteners 171 (e.g., screws, rivets, or the like) for movement with the handle 26. In the illustrated embodiment, the upper housing portion 170 receives a portion of the lower housing portion 166 such that the upper housing portion 170 is pivotally coupled to the lower housing portion 166. As such, when the handle 26 pivots relative to the base 14, the upper housing portion 170 pivots in a similar manner relative to the lower housing portion 166. The illustrated housing assembly 30 increases the aesthetic appearance of the stapler 10 in addition to providing contours for improved gripping of the stapler 10 during operation. The slight additional length provided by the housing assembly 30 accommodates the drive member 66 rearward of the pins 70, 78.

Referring to FIGS. 4A-4C, the lower housing portion 166 includes a rear flange 172 that extends upwardly from the lower housing portion 166. When the handle 26 is pivoted about the second pivot axis 82 toward the base 14 (as shown in FIG. 4B), the rear flange 172 helps bias the handle 26 away from the base 14. When the handle 26, and thereby the drive arm 22 and the case 20, is pivoted about the second pivot axis 82 away from the base 14 (as shown in FIG. 4C), the rear flange 172 engages the drive arm 22 to limit the pivoting range of the drive arm 22 and the case 20.

Figure 5:
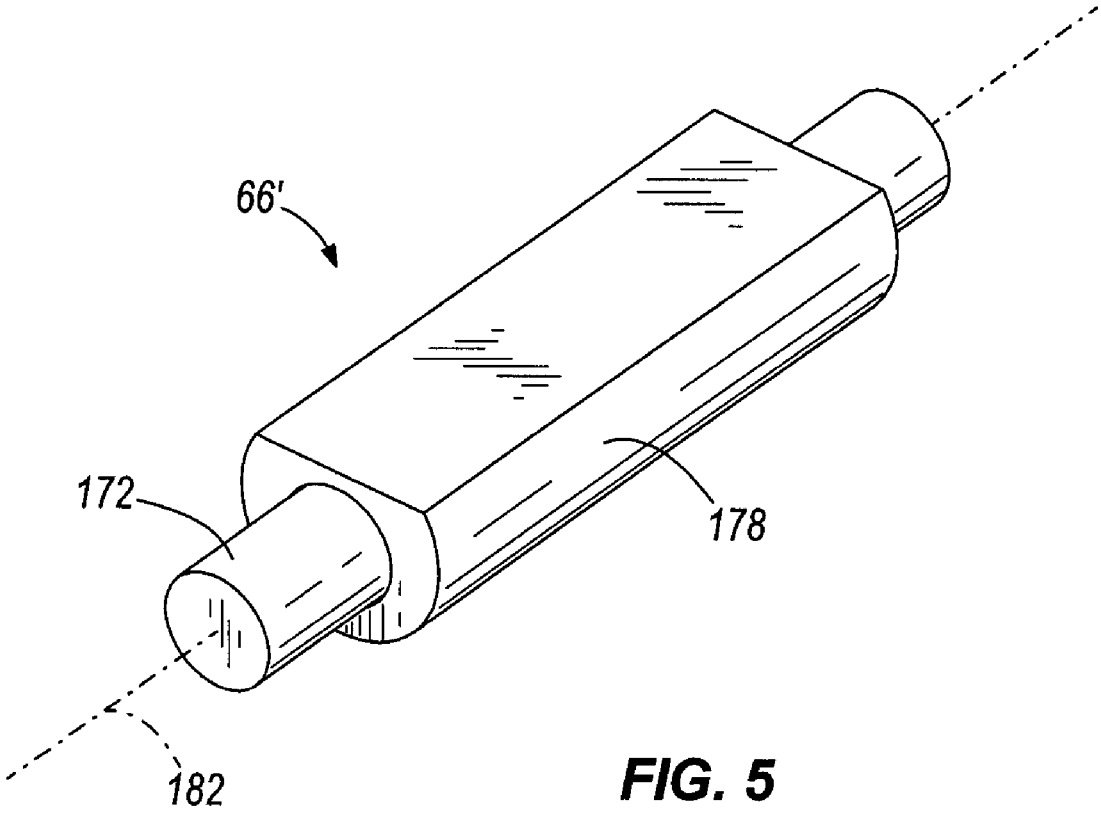
FIG. 5 is a perspective view of a slider for use with the stapler shown in FIG. 1.

In the illustrated embodiment, the drive member 66 includes a shaft 173 and a roller 174 surrounding a portion of the shaft 173. When the roller 174 contacts the lower surface 162 of the drive arm 22, the roller 174 rotates relative to the shaft 173 to roll along the lower surface 162. In some embodiments, an alternative drive member 66' may include a slider 178 (FIG. 5) that surrounds a portion of the shaft 173 and slides along the lower surface 162. In such embodiments, the slider 178 may be made from or covered with a low friction material. In other embodiments, the drive member 66, 66' may be split into two pieces, or tabs, that extend downwardly from the handle 26 to engage the lower surface 162 of the drive arm 22, but do not extend entirely across the lower surface 162. Additionally or alternatively, in some embodiments, the drive member 66, 66' may be integrally formed as a single piece with the handle 26.

Referring to FIG. 4A, the distal end of the front portion 122 of the drive arm 22 is spaced a first distance A from the first pivot axis 74 and a longitudinal axis 182 of the drive member 66 is spaced a second distance B from the first pivot axis 74. In addition, the first pivot axis 74 is spaced a third distance C from a bottom surface of the base 14 and the longitudinal axis 182 of the drive member 66 is spaced a fourth distance D from the bottom surface of the base 14. In the illustrated embodiment, the first distance A is greater than the second distance B, and the fourth distance D is greater than the third distance C. In other embodiments, the first distance A and the fourth distance D may be greater than the second distance B and the third distance C, respectively, by a greater or lesser amount than that illustrated. Furthermore, the first pivot axis 74 is spaced a fifth distance E from the second pivot axis 82 and is spaced a sixth distance F from the longitudinal axis 182. In some embodiments, a ratio of the fifth distance E to the sixth distance F is between about 0.35 and about 0.55. In the illustrated embodiment, the ratio is approximately 0.47.

As shown in FIGS. 4A and 4B, the front portion 122 of the drive arm 22 (e.g., a point approximately above the driver 120 when the stapler 10 is in an actuated, or operating, position) moves a first pivot distance relative to the base 14 (i.e., from a first distance $G_1$ to a second distance $G_2$) as the drive arm 22 pivots about the first pivot axis 74 from the rest position to the stapling position, and the front portion 158 of the handle 26 moves a second pivot distance relative to the base 14 (i.e., from a first distance $H_1$ to a second distance $H_2$) as the handle 26 pivots about the second pivot axis 82 from the rest position to the stapling position. In some embodiments, the ratio of the second pivot distance to the first pivot distance (i.e., the ratio of the handle travel to the driver travel) is between about 1.5 and about 2.3. In the illustrated embodiment, the first pivot distance is about 15 millimeters (mm), the second pivot distance is about 29 mm, and the ratio is about 1.9.

As shown in FIG. 4A, the magazine 18 is spaced an opening distance O from the base 14 when the stapler 10 is in a rest position. In such an arrangement, each of the first and second pivot distances includes an active travel component and a free travel component. When the handle 26 is pivoted from the rest position about the second pivot axis 82 relative to the base 14, the magazine 18, the drive arm 22, and the driver 120 pivot together about the first pivot axis 74 until the magazine 18 contacts two or more sheets S (FIG. 4B) positioned on the base 14 (i.e., the free travel component). As such, in the illustrated embodiment, the free travel component is approximately equal to the opening distance O minus the height of the sheets S. After the magazine 18 contacts the sheets S, the handle 26 continues to pivot about the second pivot axis 82, thereby pivoting the drive arm 22 and the driver 120 about the first pivot axis 74 relative to the magazine 18 (i.e., the active travel component). In some embodiments, the ratio of the active travel component of the handle 26 to the active travel component of the drive arm 22 or driver 120 is between about 1.7 and about 2.5. In the illustrated embodiment, the ratio is about 2.1.

The illustrated arrangement creates a "see-saw" type movement of the drive arm 22 to drive a staple from the magazine 18. When an operator presses the upper housing portion 170 toward the base 14 against the bias of the rear flange 172, the handle 26 is pivoted about the second pivot axis 82 (e.g., from a rest position shown in FIG. 4A to an operating position shown in FIG. 4B) such that the front portion 154 of the handle 26 is pivoted toward the base 14 and the rear portion 146 of the handle 26, and thereby the drive member 66, is pivoted away from the base 14. As the drive member 66 pivots away from the base 14, the drive member 66 exerts an upward force on the lower surface 162 of the drive arm 22, pivoting the rear portion 130 of the drive arm 22 away from the base 14 and the front portion 122 of the drive arm 22, and thereby the driver 120, toward the base 14 about the first pivot axis 74.

Initially, as the front portion 122 of the drive arm 22 pivots toward the base 14, the biasing member 123 exerts a force on the case 20 to pivot the case 20 and the magazine 18 about the first pivot axis 74 against the bias of the biasing member 92. Once the magazine 18 contacts two or more sheets S positioned on the base 14 (as shown in FIG. 4B), the magazine 18 and the case 20 stop pivoting relative to the base 14, but the handle 22 begins to pivot relative to the magazine 18 and the case 20 against the bias of the biasing member 123. When the handle 22 pivots relative to the magazine 18 and the case 20, the driver 120 passes through the chamber 94 of the magazine 18 and pushes a staple through the slot 102 in the magazine 18 toward the anvil 46, binding the sheets S clamped between the base 14 and the magazine 18. After this stapling operation, the operator releases the pressure on the upper housing portion 170, allowing the biasing members 92, 123 and the rear flange 172 to return the stapler 10 to the rest position shown in FIG. 4A.

Figure 6:
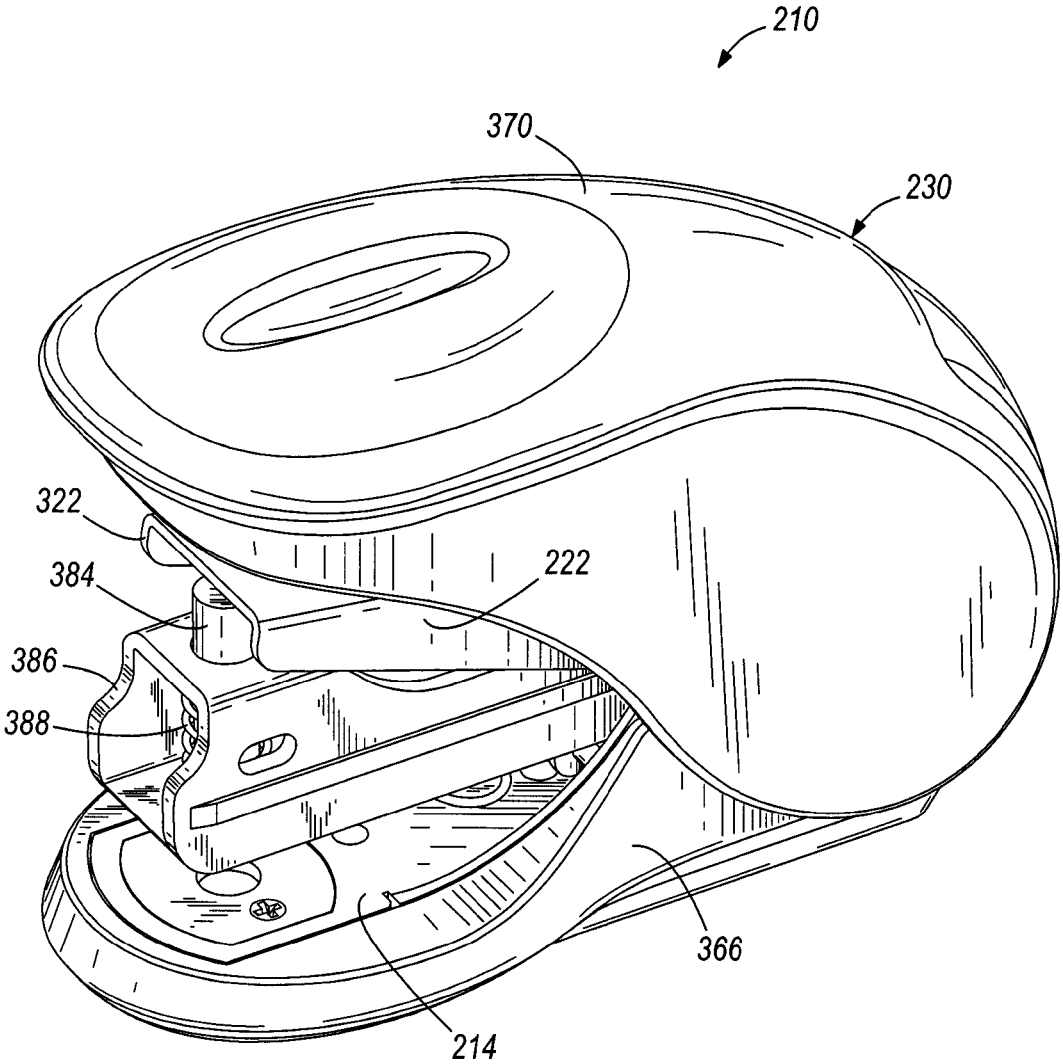
FIG. 6 is a perspective view of a hole punch according to a second embodiment of the invention.

FIG. 6 illustrates a paper tool 210 according to another embodiment of the invention. The illustrated paper tool 210 is similar to the paper tool 10 shown in FIGS. 1-4, and like parts have been given the same reference numbers plus 200.

In the illustrated embodiment, the paper tool 210 is a one-hole punch. The illustrated punch 210 includes a punch pin 384 coupled to the front portion of a punch housing 386 to punch a hole in one or more sheets of paper. In other embodiments, the hole punch 210 may include fewer or more punch pins (e.g., a two-hole punch, a three-hole punch, etc.) to simultaneously punch more holes in the sheets. A biasing member 388 (e.g., a coil spring) surrounds a portion of the punch pin 384 within the punch housing 386 to bias the punch pin 384 away from the base 214.

When the upper housing portion 370 is pivoted toward the base 214, the front portion 322 of the drive arm 222 is pivoted toward the base 214 by lifting the lower surface of the drive arm 222 with the drive member (not shown). The front portion 322 thereby engages the punch pin 384 to push the punch pin 384 against the bias of the biasing member 388 toward the base 214, punching a hole in the sheets.

Figure 7:
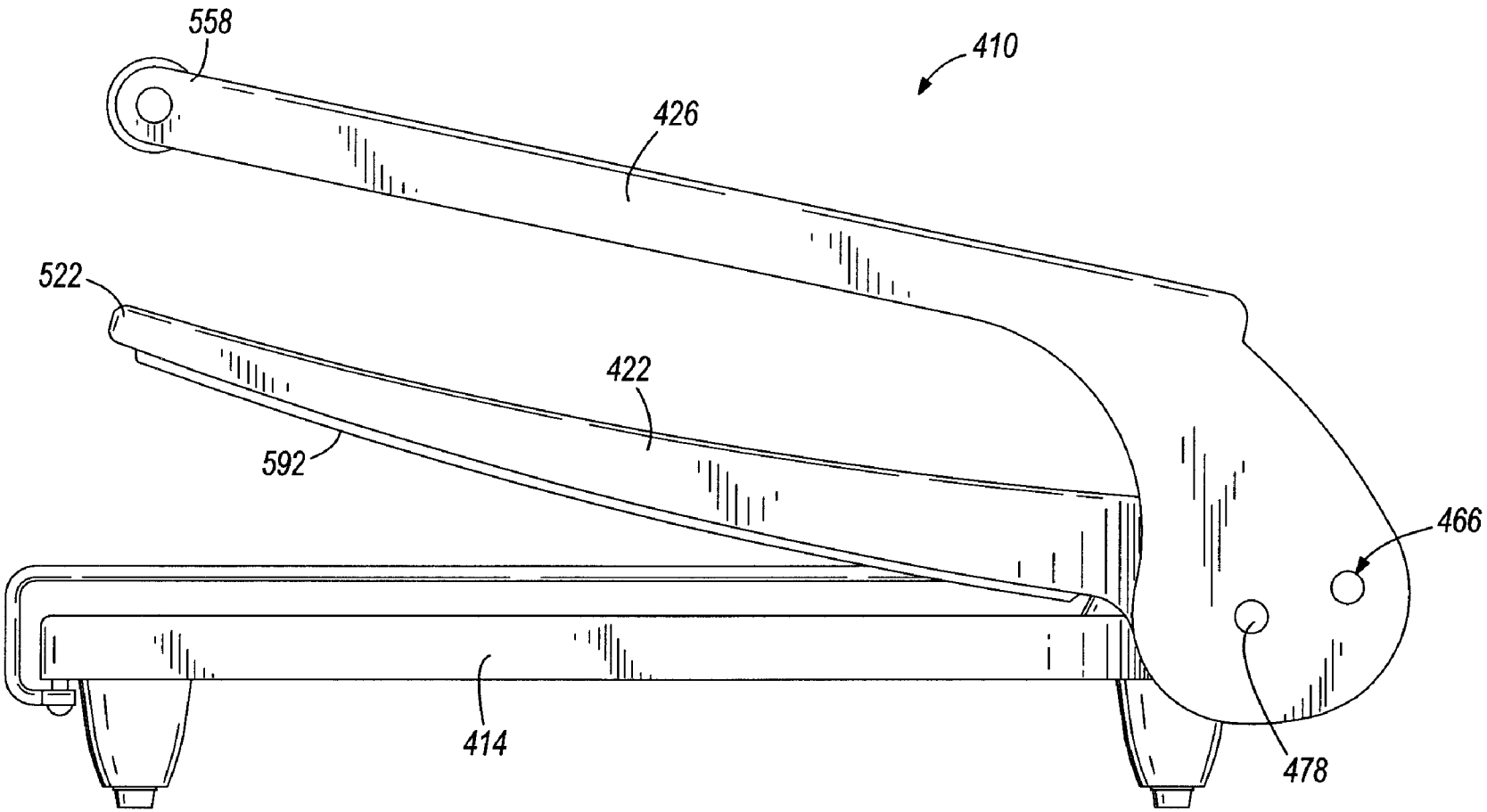
FIG. 7 is a side view of a paper cutter according to a third embodiment of the invention.

FIG. 7 illustrates a paper tool 410 according to still another embodiment of the invention. The illustrated paper tool 410 is similar to the paper tool 10 shown in FIGS. 1-4, and like parts have been given the same reference numbers plus 400.

In the illustrated embodiment, the paper tool 410 is a paper cutter or trimmer. The illustrated paper cutter 410 includes a blade 592 coupled to the drive arm 422 to cut one or more sheets of paper. When the front portion 558 of the handle 426 is pivoted toward the base 414, the drive member 466 engages the lower surface (not shown) of the drive arm 422 to pivot the drive arm 422, and thereby the blade 592, about the second pivot pin 478 toward the base 414, cutting the sheets.

Figure 8:
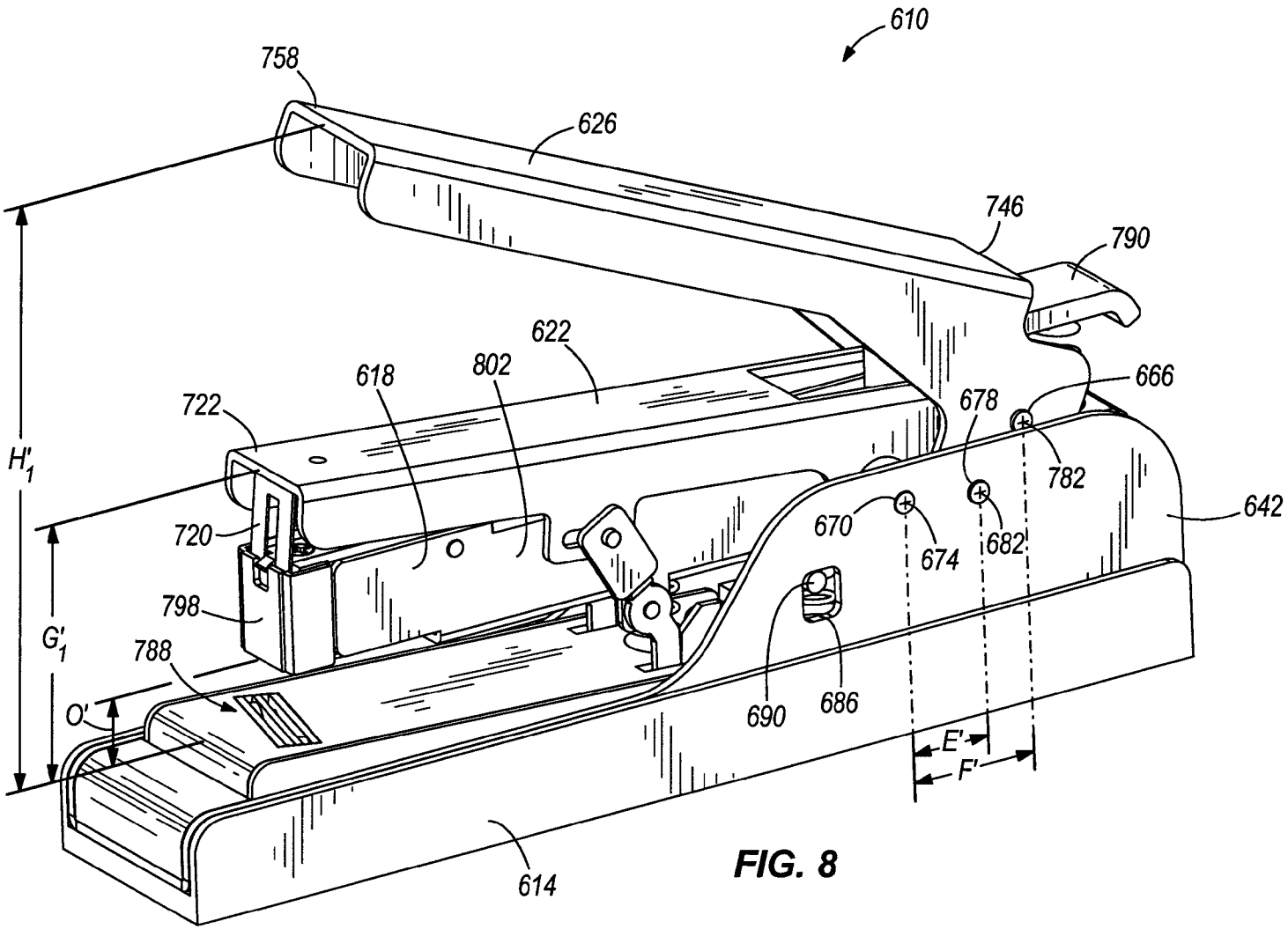
FIG. 8 is a perspective view of a stapler according to a fourth embodiment of the invention.
Figure 9:
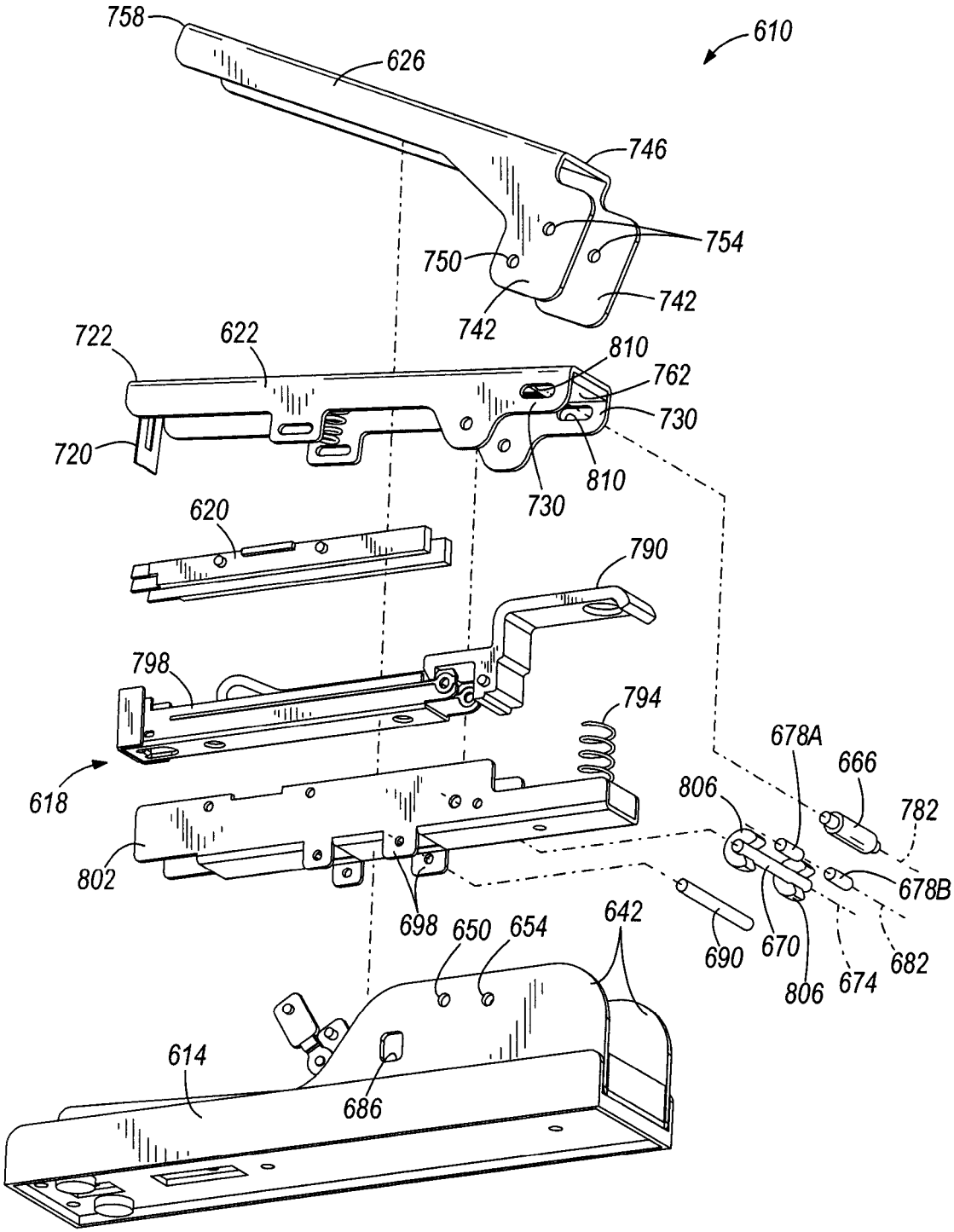
FIG. 9 is an exploded perspective view of the stapler of FIG. 8.

FIGS. 8 and 9 illustrate a paper tool 610 according to yet another embodiment of the invention. The illustrated paper tool 610 is similar to the paper tool 10 shown in FIGS. 1-4, and like parts have been given the same reference numbers plus 600.

In the illustrated embodiment, the paper tool 610 is a stapler. The illustrated stapler 610 includes a flat clinch mechanism 788 to engage and bend a staple. However, it should be readily apparent to one skilled in the art that in other embodiments the stapler 610 may include a stationary anvil to bend a staple. In addition, the stapler 610 includes a release lever 790 to facilitate refilling of the magazine 618 with staples. The illustrated release lever 790 is actuatable against a biasing member 794 to unlock an inner portion 798 of the magazine 618, allowing the inner portion 798 to slide forward relative to an outer portion 802 and be refilled with staples. In the illustrated embodiments, a biasing member (not shown) biases the inner portion 798 forward when the release lever 790 is actuated.

The magazine 618 and the drive arm 622 are pivotally coupled to the base 614 about the first pivot axis 674 by the first pin 670. As shown in FIG. 9, the first pin 670 includes a spacer 806 adjacent to each end of the first pin 670 to maintain proper spacing between the drive arm 622 and the flanges 642, or hips, of the base 614. The illustrated drive arm 622 includes a generally horizontal slot 810 formed in each rear portion 730 of the drive arm 622, similar to the generally linear portions 134 of the T-shaped slots 126 discussed above with reference to FIG. 3. The horizontal slots 810 provide clearance to allow the drive member 666 to move laterally relative to the drive arm 622 when the handle 626 is pivoted.

The handle 626 is pivotally coupled to the base 614 about the second pivot axis 682 by the second pin 678. In the illustrated embodiment, the second pin 678 is split into two pin portions 678A, 678B such that the second pin 678 does not extend through the magazine 618 or the drive arm 622, allowing the pin portions 678A, 678B to translate relative to the magazine 618 and the drive arm 622. The illustrated handle 626 supports the drive member 666 such that, as the front portion 758 of the handle 626 pivots downwardly about the second pivot axis 682, the handle 626 lifts the drive member 666 away from the base 614. Similar to the drive member 66 discussed above with reference to FIGS. 3 and 4A, the drive member 666 engages and exerts upward force on the lower surface 762 of the drive arm 622 to pivot the drive arm 622 about the first axis 674.

As shown in FIG. 8, the first pivot axis 674 is spaced a fifth distance E' from the second pivot axis 682 and is spaced a sixth distance F' from the longitudinal axis 782 of the drive member 666. In some embodiments, the ratio of the fifth distance E' to the sixth distance F' is between about 0.45 and 0.65. In the illustrated embodiment, the ratio is approximately 0.55.

Similar to the stapler 10 discussed above with reference to FIGS. 4A and 4B, the front portion 722 of the drive arm 622 may move a first pivot distance relative to the base 614 (i.e., from a first distance $G_1$' to a second distance) as the drive arm 622 pivots about the first pivot axis 674 from the rest position to the stapling position, and the front portion 758 of the handle 626 may move a second pivot distance relative to the base 614 (i.e., from the a first distance $H_1$' to a second distance) as the handle 626 pivots about the second pivot axis 682 from the rest position to the stapling position. In some embodiments, the ratio of the second pivot distance to the first pivot distance (i.e., the ratio of the handle travel to the driver travel) is between about 2.0 and about 4.0. In the illustrated embodiment, the first pivot distance is about 29 mm, the second pivot distance is about 85 mm, and the ratio is about 3.0.

As shown in FIG. 8, similar to the magazine 18 discussed above, the magazine 618 is spaced an opening distance O' from the base 614 when the stapler 610 is in a rest position. Accordingly, each of the first and second pivot distances includes an active travel component and a free travel component. In some embodiments, the ratio of the active travel component of the handle 626 to the active travel component of the drive arm 622 or driver 720 is between about 2.8 and about 3.6. In the illustrated embodiment, the ratio is about 3.2.

In operation, the stapler 610 functions similar to the stapler 10 discussed above. When an operator presses the front portion 758 of the handle 626 toward the base 614, the handle 626 is pivoted about the second pivot axis 682 such that the rear portion 746 of the handle 626, and thereby the drive member 666, is pivoted away from the base 614. As the drive member 666 pivots away from the base 614, the drive member 666 exerts an upward force on the lower surface 762 of the drive arm 622, pivoting the rear portion 730 of the drive arm 622 away from the base 614 and the front portion 722 of the drive arm 622, and thereby the driver 720, toward the base 614. In the illustrated embodiment, when the driver 720 pushes a staple out of the magazine 618 toward the base 614, the staple is bent with the flat clinch mechanism 788, rather than by a stationary anvil.

Various features and advantages of the invention are set forth in the following claims.

What is claimed is:

1. A paper tool comprising:

a base having a front end and a rear end;

a drive arm pivotally coupled to the base about a first pivot axis, the drive arm including a front portion proximate the front end of the base and a rear portion proximate the rear end of the base;

a handle pivotally coupled to the base;

a drive member supported by the handle rearwardly of the first pivot axis such that, when the handle pivots relative to the base, the drive member engages the rear portion of the drive arm to pivot the drive arm about the first pivot axis; and a pin coupling the handle to the base and defining a second pivot axis, wherein the pin extends through a portion of the drive arm, and wherein the drive arm includes a slot to allow movement of the pin relative to the drive arm.

2. The paper tool of claim 1, wherein the drive arm includes a driver operable to drive a staple.

3. The paper tool of claim 1, wherein the drive arm engages a punch pin operable to punch a sheet.

4. The paper tool of claim 1, wherein the drive arm includes a cutting blade operable to cut a sheet.

5. The paper tool of claim 1, wherein the drive member includes a roller that engages the rear portion of the drive arm to pivot the drive arm about the first pivot axis.

6. The paper tool of claim 1, wherein the drive member includes a sliding contact surface that engages the rear portion of the drive arm to pivot the drive arm about the first pivot axis.

7. The paper tool of claim 1, wherein the second pivot axis is disposed rearwardly of the first pivot axis.

8. The paper tool of claim 7, wherein the first pivot axis is spaced a first distance from the second pivot axis and is spaced a second distance from a center of the drive member, and wherein the ratio of the first distance to the second distance is between about 0.35 and about 0.65.

9. The paper tool of claim 1, wherein the drive member extends through the slot of the drive arm to allow movement of the drive member relative to the drive arm.

10. The paper tool of claim 1, wherein the front portion of the drive arm moves a first pivot distance as the drive arm pivots about the first pivot axis from a rest position to a stapling position, and a front portion of the handle moves a second pivot distance as the handle pivots relative to the base from a rest position to a stapling position, and wherein the ratio of the second pivot distance to the first pivot distance is at least about 1.5.

11. The paper tool of claim 10, wherein the ratio is between about 1.5 and about 4.0.

12. The paper tool of claim 9, wherein the slot is generally T-shaped.

13. The paper tool of claim 9, wherein the slot has a generally linear portion receiving the drive member, and an arcuate portion receiving the pin.

14. A stapler comprising:

a base having a front end and a rear end;

a magazine pivotally coupled to the base;

a drive arm pivotally coupled to the base about a first pivot axis and operable to drive a staple from the magazine, the drive arm including a front portion proximate the front end of the base and a rear portion proximate the rear end of the base;

a handle pivotally coupled to the base; and a drive member supported by the handle rearwardly of the first pivot axis such that, when the handle pivots relative to the base, the drive member engages the rear portion of the drive arm to pivot the drive arm about the first pivot axis;

wherein the magazine is pivotally coupled to the base at the first pivot axis.

15. The stapler of claim 14, wherein the drive member includes a roller that engages the rear portion of the drive arm to pivot the drive arm about the first pivot axis.

16. The stapler of claim 14, wherein the drive member includes a sliding contact surface that engages the rear portion of the drive arm to pivot the drive arm about the first pivot axis.

17. The stapler of claim 14, further comprising a housing assembly including a first housing portion surrounding at least a portion of the base and a second housing portion coupled to the first housing portion and surrounding at least a portion of the handle.

18. The stapler of claim 14, wherein the drive member extends through a portion of the drive arm, and wherein the drive arm includes a slot to allow movement of the drive member relative to the drive arm.

19. The stapler of claim 14, wherein the handle is pivotally coupled to the base about a second pivot axis disposed rearwardly of the first pivot axis.

20. The stapler of claim 19, wherein the first pivot axis is spaced a first distance from the second pivot axis and is spaced a second distance from a center of the drive member, and wherein the ratio of the first distance to the second distance is between about 0.35 and about 0.65.

21. The stapler of claim 14, further comprising a pin coupling the handle to the base and defining a second pivot axis, wherein the pin extends through a portion of the drive arm, and wherein the drive arm includes a slot to allow movement of the pin relative to the drive arm.

22. The stapler of claim 21, wherein the drive member extends through the slot of the drive arm to allow movement of the drive member relative to the drive arm.

23. The stapler of claim 14, wherein the front portion of the drive arm moves a first pivot distance as the drive arm pivots about the first pivot axis from a rest position to a stapling position, and a front portion of the handle moves a second pivot distance as the handle pivots relative to the base from a rest position to a stapling position, and wherein the ratio of the second pivot distance to the first pivot distance is at least about 1.5.

24. The stapler of claim 23, wherein the ratio is between about 1.5 and about 4.0.

25. A stapler comprising:

a base having a front end and a rear end;

a magazine pivotally coupled to the base;

a drive arm pivotally coupled to the base about a first pivot axis and operable to drive a staple from the magazine, the drive arm including a front portion proximate the front end of the base and a rear portion proximate the rear end of the base;

a handle pivotally coupled to the base;

a drive member supported by the handle rearwardly of the first pivot axis such that, when the handle pivots relative to the base, the drive member engages the rear portion of the drive arm to pivot the drive arm about the first pivot axis; and a pin coupling the handle to the base and defining a second pivot axis, wherein the pin extends through a portion of the drive arm, and wherein the drive arm includes a slot to allow movement of the pin relative to the drive arm.

26. The stapler of claim 25, wherein the drive member extends through the slot of the drive arm to allow movement of the drive member relative to the drive arm.

27. The stapler of claim 26, wherein the slot is generally T-shaped.

28. The stapler of claim 26, wherein the slot has a generally linear portion receiving the drive member, and an arcuate portion receiving the pin.

* * * * *